United States Patent [19]

Theurer

[11] Patent Number: 4,774,890

[45] Date of Patent: Oct. 4, 1988

[54] MOBILE TRACK RENEWAL INSTALLATION

[75] Inventor: Josef Theurer, Vienna, Austria

[73] Assignee: Franz Plasser Bahnbaumaschinen-Industriegesellschaft m.b.H, Vienna, Austria

[21] Appl. No.: 944,366

[22] Filed: Dec. 22, 1986

[30] Foreign Application Priority Data

Feb. 12, 1986 [AT] Austria ..... 359/86

[51] Int. Cl.[4] ..... E01B 27/11; E01B 27/13

[52] U.S. Cl. ..... 104/7.1; 104/9; 104/12; 104/17.1

[58] Field of Search ..... 104/2, 5, 6, 7.1, 9, 104/10, 12, 17.1, 7.2, 17.2

[56] References Cited

U.S. PATENT DOCUMENTS

| | | | |
|---|---|---|---|
| 3,628,461 | 12/1971 | Plasser et al. | 104/17.1 |
| 3,680,486 | 8/1972 | Plasser et al. | 104/307 |
| 3,685,456 | 8/1972 | Plasser et al. | 104/2 |
| 4,108,076 | 8/1978 | Knape | 104/2 |
| 4,165,694 | 8/1979 | Theurer | 104/12 X |
| 4,257,331 | 3/1981 | Theurer et al. | 104/2 |
| 4,479,439 | 10/1984 | Theurer et al. | 104/7.1 |
| 4,538,687 | 9/1985 | Theurer et al. | 104/2 X |

FOREIGN PATENT DOCUMENTS 346891 11/1978 Austria .

OTHER PUBLICATIONS

Railway Gazette International, Feb. 1985, pp. 120/1.

*Primary Examiner*—Robert B. Reeves
*Assistant Examiner*—Scott H. Werny
*Attorney, Agent, or Firm*—Kurt Kelman

[57] ABSTRACT

A mobile track renewal installation for the continuous replacement of the rails and ties of a track comprises a leading and a trailing work vehicle arranged for continuous advancement on a track in an operating direction. The leading work vehicle bridges an intermediate renewal section where an existing track is replaced by a new track and carries a ballast excavating and planing apparatus for removing ballast from the ballast bed and planing the remaining ballast bed, and an apparatus for laying ties on the planed ballast immediately behind the ballast excavating and planing apparatus, in the operating direction. The trailing work vehicle carries apparatus for fastening rails to the laid ties and an operating unit for lifting the track and for tamping the ballast under the ties trailing the apparatus for fastening the rails to the laid ties, the operating unit being intermittently displaceable on the trailing vehicle in the operating direction. A displacement drive connects the operating unit to the trailing vehicle for intermittently displacing the operating unit.

8 Claims, 1 Drawing Sheet

MOBILE TRACK RENEWAL INSTALLATION

BACKGROUND OF THE INVENTION

1. Field of the Invention

The present invention relates to a mobile track renewal installation for the continuous replacement of the rails and ties of a track, which comprises a leading and a trailing work vehicle arranged for continuous advancement on a track in an operating direction, the leading vehicle bridging an intermediate renewal section where an existing track is replaced by a new track and carrying a ballast excavating and planing apparatus for removing ballast from the ballast bed and planing the remaining ballast bed, and an apparatus for laying ties on the planed ballast bed immediately behind the ballast excavating and planing apparatus, and the trailing work vehicle carrying apparatus for fastening rails to the laid ties.

2. Description of the Prior Art

This type of a mobile track renewal installation for the continuous replacement of the rails and ties of a track is disclosed in U.S. Pat. No. 3,685,456, dated Aug. 22, 1972, which comprises a track renewal train comprised of a plurality of work vehicles arranged for continuous advancement on a track in an operating direction. A leading tripartite work vehicle bridges an intermediate trackless renewal section, the central part thereof constituting a ballast cleaning machine supported on the ballast bed of the trackless renewal section on full-track undercarriages and carrying an endless ballast excavating chain, a ballast cleaning screening arrangement receiving the excavated ballast from the chain and a discharge conveyor for throwing the cleaned ballast onto the bed. The forward part of the leading work vehicle carries an apparatus for receiving the old ties and the rear part carries an apparatus for laying the new ties, suitable conveyor means being provided for transporting the old and the new ties from and to the respective apparatus. A trailing work vehicle carries apparatus for fastening the newly laid rails to the newly laid ties as well as a chute which receives and discharges cleaned ballast. A conveyor band is arranged between the ballast cleaning screening arrangement and the chute for conveying the cleaned ballast and discharging it into the cribs of the newly laid track. This mobile track renewal installation has been used with great success but the new track produced therewith is not fixed in a desired position with sufficient accuracy and stability for permanent use with high-speed trains. To achieve this result, the installation must be followed in a further operating stage by a track leveling and ballast tamping machine which properly levels and, if necessary, lines the newly laid track and then fixes it in position permanently by tamping ballast under the ties.

An advertisement in "Railway Gazette International", February 1985, pages 120/1, describes an installation for rehabilitating the subgrade of a track bed in combination with a track leveling, lining and tamping apparatus by continuously excavating an existing ballast bed and laying a new sand layer under a new ballast layer. This installation comprises a central main machine carrying a ballast excavating chain and conveyor apparatus for transporting sand and new ballast, a trailing satellite machine and a number of freight cars. The satellite machine carries a leveling-lining-tamping operating unit between its two undercarriages, which moves cyclically from tie to tie while the machine advances continuously with the main machine. Tamping is effected by vibratory and reciprocatory tamping tools which tamp ballast under the ties. While the dirty ballast is conveyed from the excavating chain to freight cars running ahead of the main machine, a gantry crane brings containers filled with sand and clean ballast to storage bins for sand and ballast. Suitable conveyor arrangements convey the sand and the ballast from the storage bins forwardly to a discharge point on the main machine rearwardly of the excavating chain to lay the sand and superposed ballast layers. Another discharge point for the ballast is provided ahead of the tamping unit. The satellite machine is integrated into the installation by the track for the gantry crane and the conveyor arrangement for conveying the ballast to the main machine. This installation has been used successfully but requires very extensive and correspondingly expensive conveyor arrangements for transporting the sand and ballast.

U.S. Pat. No. 4,479,439, dated Oct. 30, 1984, also discloses an installation for rehabilitating the subgrade of a track bed in a continuous manner. The leading work vehicle of this installation bridges a renewal section and carries an endless ballast excavating chain passing under the track and a trailing conveyor arrangement for the separate transport of sand and ballast. The rear end of the vehicle carries a sand storage bin mounted above the sand conveyor. A trailng work vehicle carries a ballast storage bin mounted above a rear end of the ballast conveyor. Tracks are mounted above the vehicle frames for guiding a gantry crane transporting containers filled with sand and ballast to the respective storage bins. A longitudinally displaceable leveling-lining-tamping unit is mounted behind the ballast storage bin. This installation is designed for the removal of the entire old ballast bed so that a sand layer may be laid on the cleared subgrade to improve drainage, whereupon a new ballast bed is laid on the sand layer and planed. The track remains unchanged and is tamped after it has been lowered onto the new ballast bed by the tamping unit on the trailing vehicle.

U.S. Pat. No. 3,628,461, dated Dec. 21, 1971, discloses a machine for working on rail fastening elements. This machine forms a part of a track renewal installation and comprises a frame supported on a track by undercarriages. A pair of operator's cabs are suspended from an underside of the machine frame and a respective apparatus for detaching and attaching rail fastening elements is longitudinally displaceably mounted on guide tracks on the machine frame underside behind each cab. This apparatus is supported on the track. In a similar flat bed car disclosed in U.S. Pat. No. 3,680,486, dated Aug. 1, 1972, a series of such operator's cabs are mounted underneath the flatbed and conveyors for rail fastening elements are arranged to convey the fastening elements from and to the cabs to enable operators therein quickly to detach and attach the fastening elements. However, it may be difficult to fasten the laid rails to the ties with this apparatus because the deposition of ballast in the cribs may make it impossible for the fastening tools to engage the fastening elements.

Austrian Pat. No. 346,891, dated Apr. 15, 1978, discloses a ballast cleaning machine with a ballast excavating chain discharging the excavated ballast into a ballast screening arrangement which, in turn, discharges the cleaned ballast into a storage bin whence the cleaned ballast is redistributed by a first conveyor arrangement and excess ballast may be moved away by a second conveyor at the rear of the machine.

SUMMARY OF THE INVENTION

It is the primary object of this invention to improve a mobile track renewal installation for the continuous replacement of the rails and ties of a track of the type disclosed in U.S. Pat. No. 3,685,456 by increasing its operating speed and efficiency so that an accurately positioned and permanently fixed track is obtained immediately after the track renewal operation.

The above and other objects are accomplished in accordance with the invention by mounting an operating unit for lifting the track and for tamping the ballast under the ties on the trailing work vehicle. The operating unit trails the apparatus for fastening the rails to the laid ties and is intermittently displaceable on the trailing vehicle in the operating direction. A displacement drive connects the operating unit to the trailing vehicle for intermittently displacing the operating unit.

This installation enables the track renewal operations and the finishing track correction operations to be economically effectuated substantially in a single operating stage and continuously as the installation advances along the track. The arrangement has the additional advantage of achieving a high degree of accuracy in the track positioning since the stationary reference system conventionally used for controlling the various operating units of a track renewal train can be used also for controlling the operation of the track lifting/lining and the ballast tamping operating unit. In this way, the newly laid track may be positioned on a planed level and lined without additional equipment and may be immediately fixed in this position by tamping the ties. Since the operating unit is cyclically displaceable for the successive tamping of the ties, the entire track renewal installation may continuously advance without interruption.

BRIEF DESCRIPTION OF THE DRAWING

The above and other objects, advantages and features of the present invention will become more apparent from the following detailed description of a now preferred embodiment thereof, taken in conjunction with the accompanying, generally schematic drawing showing the mobile track renewal installation in side elevational view and wherein.

DESCRIPTION OF THE PREFERRED EMBODIMENT

Figures 1, 2, 3:
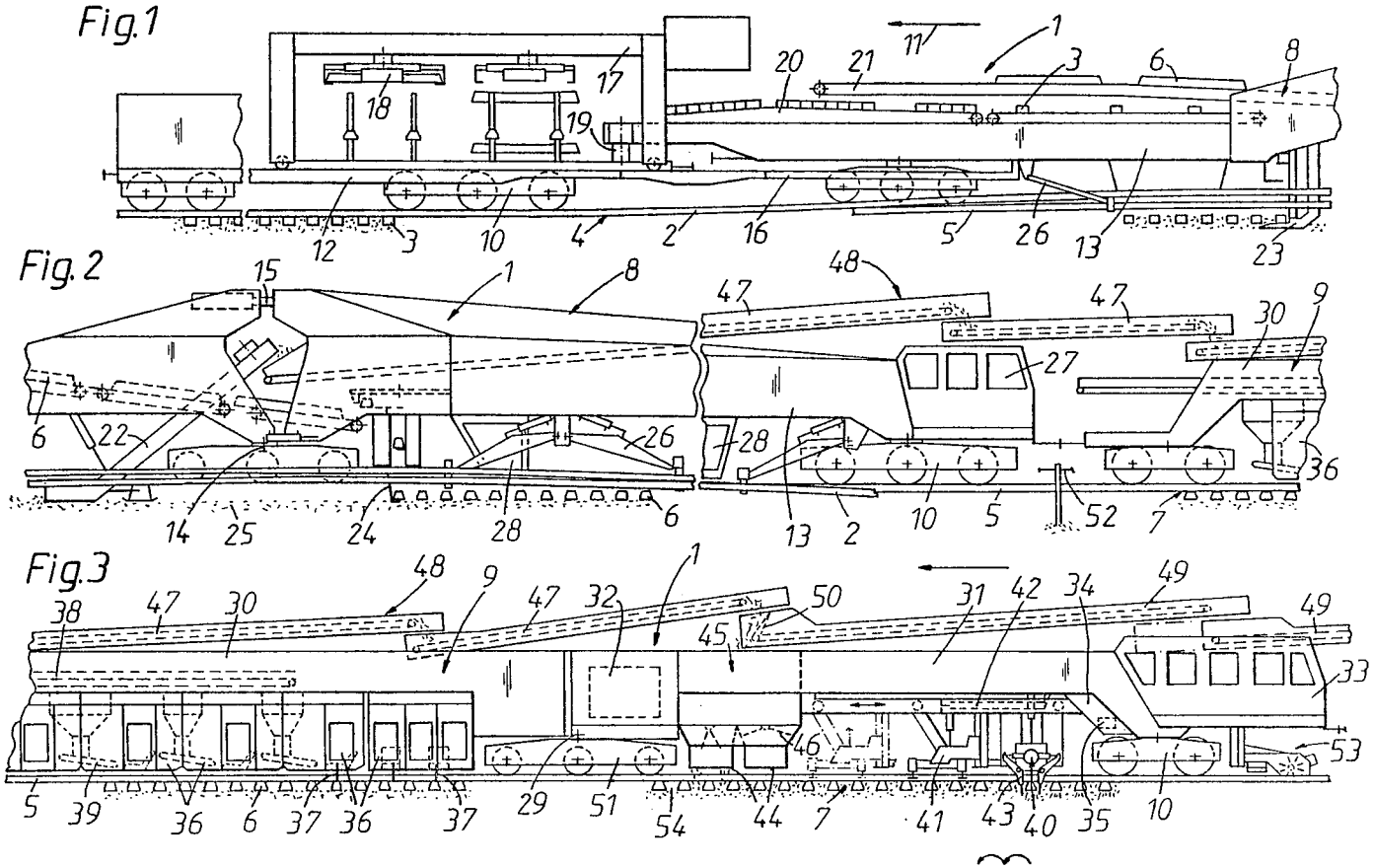
FIG. 1 illustrates the front part of the leading work vehicle.
FIG. 2 illustrates the rear part of the leading work vehicle in continuation of FIG. 1, and also shows the front end of the trailing work vehicle.
FIG. 3 illustrates the trailing work vehicle.

Illustrated mobile track renewal installation 1 is shown as a track renewal train for the continuous removal of old track 4 comprised of rails 2 and wooden ties 3 and simultaneous laying of new track 7 comprised of rails 5 and concrete ties 6. In essence, this installation comprises leading work vehicle 8 and trailing work vehicle 9 coupled thereto for continuous advancement on track 4, 7 in an operating direction indicated by arrow 11. Undercarriages 10 support the work vehicles on the track. Leading work vehicle 8 is designed for the track renewal operation and bridges intermediate renewal section 25 where existing track 4 is replaced by new track 7. In the illustrated embodiment, this work vehicle is comprised of forward machine frame 12 and two-part machine frame 13 whose front end is supported on machine frame 12. Pivot 14 connects the two parts of machine frame 13 (see FIG. 2) and hydraulic drive 15 enables the two machine frame parts to be pivoted apart so that the undercarriage underneath the pivot may be lifted off the track plane. Gantry crane 17 on forward machine frame 12 is movable in the operating direction along guide track 16 and carries vertically adjustable tie gripping and turning device 18 for picking up old ties 3 and turning them 90°. A vertically adjustable hydraulic jack 19 connects machine frames 12 and 13.

Conveyor arrangements 20, 21 are arranged on the front part of machine frame 13 for respectively removing wooden ties 3 and delivering concrete ties 6. Ballast excavating and planing apparatus 22 is mounted at the rear end of the machine frame front part near pivot 14 and comprises an endless ballast excavating chain for removing ballast from the ballast bed and a ballast compactor for planing the ballast bed. Apparatus 23 for removing the old ties precedes the ballast excavating and planing apparatus and apparatus 24 for laying the new ties on the planed ballast bed is mounted on the rear machine frame part immediately behind ballast excavating and planing apparatus 22, apparatus 23 and 24 delimiting track renewal section 25. Vertically and transversely adjustable rail guides 26 guide old rails 2, from which the ties have been removed, and new rails 5, before the ties are fastened thereto, and spread them apart in the track renewal section. Rear operator's cab 27 and operator's cabs 28 suspended from the underside of machine frame 13 are arranged on leading work vehicle 8.

Trailing work vehicle 9 carries apparatus 36, 37 for fastening rails 5 to ties 6 and an operating unit 40, 41 for lifting the track and for tamping the ballast under ties 6 the operating unit being intermittently displaceable on the trailing vehicle in the operation direction, as indicated by the short arcuate arrows. Displacement drive 42 connects the operating unit to the trailing vehicle for intermittently displacing the operating unit.

In the illustrated embodiment, trailing work vehicle further carries ballast receiving and storage container 45 mounted on the vehicle behind apparatus 36, 37 and ahead of operating unit 40, 41, in the operating direction, and the operating unit comprises track lifting unit 41 and ballast tamping unit 40 comprising pairs of vibratory and reciprocatory tamping tools 43 for tamping ballast under respective ties 6. Conveyor means 48 comprised of a series of successive endless conveyor bands 47 is arranged for selective conveyance of excavated ballast from leading vehicle 8 to ballast receiving and storage container 45. Container 45 has discharge openings adjustable by pivotal gates 46 to permit metered amounts of ballast to be discharged through outlet chutes 44 of the ballast receiving and storage container 45. This arrangement enables ballast to be distributed in the cribs of new track 7, which lies freely on the planed ballast bed, just before the ties are tamped, thus assuring the presence of sufficient ballast for the uniform tamping of the ties and the secure support of the properly positioned new track on the tamped ballast bed. Since the ballast storage container is arranged behind the apparatus for fastening the new rails to the new ties, the fastening may proceed rapidly and without hindrance by any ballast on the ties so that the track parts are solidly connected and the track may be safely and securely gripped for the subsequent leveling and/or lining operation. The conveyor means enables ballast receiving and storage container 45 to be supplied steadily with ballast so that a ballast supply will be available at all times for selective distribution according to prevailing needs. In this manner, any excess ballast generated by the ballast excavating apparatus can be used for supplying ballast needed for the subsequent tamping operation, the successive conveyor bands forming an uninterrupted conveyance path operative during the continuous advance of the installation along the right of way.

The illustrated trailing work vehicle 9 is a self-propelled vehicle with its own power plant and drive 32, and comprises frame section 30 ahead of ballast receiving and storage container 45. The apparatus for fastening new rails 5 to new ties 6 comprises a series of operator's cabs 36 suspended from an underside of frame section 30. Cabs 36 are arranged in successive pairs aligned transversely to the operating direction in association with each rail and holding operator's seats and vertically and longitudinally adjustable devices 37 for fastening the rails to the ties. Ballast conveyor means 48 extends above operator's cabs 36 and endless conveyor band 38 is arranged on the leading frame section 30 between conveyor means 48 and cabs 36 for conveying rail fastening elements to the cabs. Chutes are arranged along the conveyor band 38 to deliver the fastening elements to vibratory conveyors 39 in cabs 36.

The trailing vehicle further comprises second frame 31 section linked to frame section 30 by pivot 29 and ballast receiving and storage container 45 as well as operating unit 40, 41 are mounted on second frame section. Displacement drive 42 connects the operating unit to the second frame section and undercarriage 51 supports trailing vehicle frame sections 30, 31 in the range of pivot 29 on track 7. Driver's cab 33 is mounted on the rear end of second frame section 31 and operator's cab 34 with central control panel 35 is mounted on the second frame section within view of operating unit 40, 41 for monitoring the track leveling/lining operation and the tie tamping.

The arrangement of the successive pairs of cabs 36 underneath the ballast conveyor means makes it possible properly to fasten the rails to all the ties without interruption of the continuous advance of the installation. Thus, a securely fastened track section is readied for the subsequent track positioning and tamping. The sectional structure of the trailing work vehicle provides a compact vehicle for the rail fastening work as well as the track leveling/lining and tamping operation, which can be uncoupled and used without problems with another type of track renewal train. The pivotal connection of the two frame sections enables the relatively long vehicle to be used without problems in track curves since the rail fastening devices, the outlet chutes of the ballast storage container, the track lifting tools and the ballast tamping tools will all be properly centered over the two rails. Endless conveyor band 38 will enable the fastening elements to be supplied to the operating sites without interference with the ballast conveyance.

Track lifting and lining unit 41 and ballast tamping unit 40 are mounted on a common tool carrier frame to constitute an operating unit which is displaceably guided in guide tracks on frame section 31 of trailing vehicle 9 and hydraulic drive 42 connects the tool carrier frame to this frame section. The lifting and lining drives of unit 41 are controlled by a stationary reference line erected laterally of the track to determine the accurate positioning of track 7. Tamping unit 40 is vertically adjustably mounted on the tool carrier frame and comprises vibratory and reciprocatory pairs of tamping tools 43 for tamping ballast under ties 6 upon immersion of the tools in the ballast. Outlet chutes 44 of ballast receiving and storage container 45 are arranged at each side of each rail at the intersection of a tie and rail so that the container has a total of eight ballast outlets arranged in two successive transverse rows. Hydraulically actuated pivotal gates 46 adjust the size of the outlet openings leading to chutes 44 to regulate the flow of ballast.

Successive endless conveyor bands 47 of conveyor means 48 are centered over vehicles 8 and 9, leading from a discharge end of ballast excavating chain 22 to container 45 for the continuous transport of excavated ballast, and this conveyor means is designed selectively to discharge the transported ballast into container 45 or to ballast conveyor means 49 also comprised of a series of endless conveyor bands and arranged on trailing work vehicle 9 above operating unit 40, 41. Ballast conveyor means 49 has a leading end associated with ballast receiving and storage container 45 and a trailing end projecting beyond a rear end of trailing work vehicle 9. The rearwardly projecting endless conveyor band of conveyor means 49 is retractibly mounted on the trailing work vehicle. Deflecting device 50 is mounted at the leading end of conveyor means 49 and may be pivoted about a transverse axis to guide the transported ballast selectively into container 45 or to conveyor means 49. In this way, excess ballast which would otherwise overflow container 45 can be transported away and can be moved either into freight cars following the installation or thrown onto the track shoulders behind the installation. On the other hand, if ballast excavating chain 22 produces an insufficient amount of ballast for effective tie tamping, the direction of movement of conveyor means 49 may be reversed and additional ballast may be transported to container 45 from freight cars in which ballast is stored and which follow the installation.

Broom arrangement 53 at the rear end of work vehicle 9 trails operating unit 40, 41 and has a vertically adjustable rotary broom extending across track 7 transversely to the operating direction for sweeping ballast off the track. This enables any ballast remaining on the ties after the tie tamping operation to be removed and possibly to be thrown onto the track shoulder by a transversely extending conveyor.

The operation of mobile track renewal installation 1 will partly be obvious from the preceding description of its structure and will now be described in detail.

As installation 1 continuously advances in the operating direction indicated by arrow 11, old wooden ties 3 will be lifted out of the ballast bed by tie receiving device 23 and will be transported by conveyor arrangement 20 to machine frame 12. Tie gripping and turning device 18 on machine frame 12 grips and turns successive ties 3 and gantry crane 17 places the turned ties on a pallet. All of these devices and operations are conventional. During the entire track renewal operation, the forward end of machine frame 13 is supported on machine frame 12 by vertically adjustable hydraulic jack 19. At the same time, the two parts of machine frame 13 are spread apart by hydraulic drive 15 so that the undercarriage underneath pivot 14 connecting the two machine frame parts is lifted above the level of the track. In the range of apparatus 23 for removing old ties 3 and apparatus 24 for laying new ties 6, vertically and transversely adjustable rail guides 26 spread old rails 2 and new rails 5 apart to enable the ties to be raised off the track and lowered to the track between the spread rails. The crib ballast of old track 4 remaining in discrete heaps between the removed old ties is excavated by the endless excavating chain of ballast excavating and planing apparatus 22 so as to produce a plane and smooth ballast bed while conveyor means 48 transports the excavated ballast rearwards. Conveyor arrangement 21 transports new concrete ties 6, which have been gripped by device 18 and turned into a longitudinal direction to enable them to be conveyed past apparatus 22, to apparatus 24 for laying the new ties on the planed and smooth ballast bed at selected spacings, as is also conventional. All these operations are carefully monitored and controlled by the operators.

Spread new rails 5 are now guided to assume the desired gage and are laid on new ties 6 so that rear undercarriage 10 of leading work vehicle 8 runs already on the newly laid track. As trailing work vehicle 9 begins to move over new track 7, the operators in cabs 36 will proceed to attach the various fastening elements to secure the new rails to the new ties. These fastening elements continue to be supplied to the operators by conveyor 38 and vibratory conveyor bands 39.

Following the rail fastening operation, ballast is thrown into the cribs of the new track in metered amounts by suitably controlling the pivoting of gates 46 which control the amount of ballast passing through outlet chutes 44 of ballast receiving and storage container 45. The discharged ballast falls at both sides of rails 5 into cribs 54 at the intersections of the ties and rails where the tamping takes place. In this manner, sufficient ballast is available for effectively tamping ballast under the ties to fix the track, which has been accurately positioned by track lifting and lining unit 41, in its position. This operation is controlled from cab 34 which is in view of the operating site so that the amount of ballast delivered through chutes 44 may be accurately controlled to obtain uniform and optimal tamping. If little ballast is required and container 45 is full, the ballast coming from conveyor means 48 is partially or completely removed by conveyor means 49, rather than being thrown into container 45. Drive 42 is operated for cyclically moving operating unit 40, 41 from tamping stage to tamping stage while installation 1 advances continuously.

What is claimed is:

1. A mobile track renewal installation for the continuous replacement of the rails and ties of a track, which comprises (a) a leading work vehicle arranged for continuous advancement on a track in an operating direction, the leading work vehicle bridging an intermediate renewal section where an existing track is replaced by a new track and carrying (1) a ballast excavating and planing apparatus for removing ballast from the ballast bed and planing the remaining ballast bed, and (2) an apparatus for laying ties on the planed ballast bed immediately behind the ballast excavating and planing apparatus, in the operating direction, (b) a trailing work vehicle arranged for continuous advancement on the track in the operating direction, the trailing vehicle carrying (1) apparatus for fastening rails to the laid ties and (2) an operating unit for lifting the track and for tamping the ballast under the ties trailing the apparatus for fastening the rails to the laid ties, the operating unit being intermittently displaceable on the trailing vehicle in the operating direction, and (c) a displacement drive connecting the operating unit to the trailing vehicle for intermittently displacing the operating unit.

2. The mobile track renewal installation of claim 1, wherein the trailing work vehicle further carries a ballast receiving and storing container mounted on the vehicle behind the apparatus for fastening the rails to the ties and ahead of the operating unit, in the operating direction, the container having adjustable ballast outlet opening means for discharging metered amounts of ballast, and the operating unit comprises a track lifting unit and a ballast tamping unit comprising pairs of vibratory and reciprocatory tamping tools for tamping ballast under respective ones of the ties.

3. The mobile track renewal installation of claim 2, further comprising conveyor means arranged for the selective conveyance of excavated ballast from the leading vehicle to the ballast receiving and storage container.

4. The mobile track renewal installation of claim 3, wherein the conveyor means comprises a series of successive endless conveyor bands.

5. The mobile track renewal installation of claim 1, further comprising a broom arrangement trailing the operating unit and having a vertically adjustable broom extending across the track transversely to the operating direction for sweeping ballast off the track.

6. A mobile track renewal installation for the continuous replacement of the rails and ties of a track, which comprises (a) a leading work vehicle arranged for continuous advancement on a track in an operating direction, the leading work vehicle bridging an intermediate renewal section where an existing track is replaced by a new track and carrying (1) a ballast excavating and planing apparatus for removing ballast from the ballast bed and planing the remaining ballast bed, and (2) an apparatus for laying ties on the planed ballast the immediately behind the ballast excavating and planing apparatus, in the operating direction, (b) a trailing work vehicle arranged for continuous advancement on the track in the operating direction, the trailing vehicle carrying (1) apparatus for fastening rails to the laid ties, (2) an operating unit comprising a track lifting unit for lifting the track and a ballast tamping unit comprising pairs of vibratory and reciprocatory tamping tools for tamping the ballast under respective ones of the ties trailing the apparatus for fastening the rails to the laid ties, the operating unit being intermittently displaceable on the trailing vehicle in the operating direction, (3) a ballast receiving and storage container mounted on the vehicle behind the apparatus for fastening the rails to the ties and ahead of the operating unit, in the operating direction, the container having adjustable ballast outlet opening means for discharging metered amounts of ballast, and (4) a ballast conveyor means arranged on the trailing work vehicle above the operating unit, the ballast conveyor means having a leading end associated with the ballast receiving and storage container and arranged for selectively discharging ballast into the container, and a trailing end projecting beyond a rear end of the trailing work vehicle, and (c) a displacement drive connecting the operating unit to the trailing vehicle for intermittently displacing the operating unit.

7. A mobile track renewal installation for the continuous replacement of the rails and ties of a track, which comprises (a) a leading work vehicle arranged for continuous advancement on a track in an operating direction, the leading work vehicle bridging an intermediate renewal section where an existing track is replaced by a new track and carrying (1) a ballast excavating and planing apparatus for removing ballast from the ballast bed and planing the remaining ballast bed, and (2) an apparatus for laying ties on the planed ballast bed immediately behind the ballast excavating and planing apparatus, in the operating direction, (b) a trailing work vehicle arranged for continuous advancement on the track in the operating direction, the trailing vehicle carrying (1) apparatus for fastening rails to the laid ties, (2) an operating unit comprising a track lifting unit for lifting the track and a ballast tamping unit comprising pairs of vibratory and reciprocatory tamping tools for tamping the ballast under respective ones of the ties trailing the apparatus for fastening the rails to the laid ties, the operating unit being intermittently displaceable on the trailing vehicle in the operating direction, (3) a ballast receiving and storage container mounted on the vehicle behind the apparatus for fastening the rails to the ties and ahead of the operating unit, in the operating direction, the container having adjustable ballast outlet opening means for discharging metered amounts of ballast, and (4) the trailing work vehicle comprising a frame section ahead of the ballast receiving and storage container and the apparatus for fastening the rails to the ties comprising a series of operator's cabs suspended from an underside of the frame section, the cabs being arranged in successive pairs aligned transversely to the operating direction and holding an operator's seat and devices for fastening the rails to the ties, a second frame section, a pivot linking the frame sections, the ballast receiving and storage container as well as the operating unit being mounted on the second frame section, (c) a displacement drive connecting the operating unit to the second frame section of the trailing work vehicle for intermittently displacing the operating unit, and (d) an undercarriage in the range of the pivot for supporting the trailing work vehicle frame sections on the track.

8. The mobile track renewal installation of claim 7, further comprising conveyor means arranged for the selective conveyance of excavated ballast from the leading vehicle to the ballast receiving and storage container, the conveyor means extending above the operator's cabs, and an endless conveyor band arranged on the leading frame section between the conveyor means and the cabs for conveying rail fastening elements to the cabs.

* * * * *